US005762515A

United States Patent [19]

Mele

[11] Patent Number: 5,762,515

[45] Date of Patent: Jun. 9, 1998

[54] SECURITY COUPLING

[76] Inventor: Peter C. Mele, P.O. Box 533, Crown Pt., N.Y. 12928

[21] Appl. No.: 611,463

[22] Filed: Mar. 4, 1996

[51] Int. Cl.[6] ..... H01R 13/52

[52] U.S. Cl. ..... 439/367; 439/369

[58] Field of Search ..... 439/366, 367, 439/368, 369, 370, 371, 373; 174/138 F

[56] References Cited

U.S. PATENT DOCUMENTS

| | | | |
|---|---|---|---|
| 3,030,601 | 4/1962 | Krebs | 439/367 |
| 3,163,481 | 12/1964 | Salvador | 439/371 |
| 3,571,782 | 3/1971 | Colbert | 439/367 |
| 4,927,377 | 5/1990 | Bach et al. | 439/371 |
| 5,179,044 | 1/1993 | Muromachi et al. | 439/369 |
| 5,397,243 | 3/1995 | MacMurdo, Sr. | 439/367 |
| 5,443,397 | 8/1995 | Carl | 439/369 |
| 5,573,420 | 11/1996 | Grosswendt | 439/369 |

*Primary Examiner*—Hien Vu
*Attorney, Agent, or Firm*—George E. Kersey, Esq.

[57] ABSTRACT

An electrical apparatus for securing a connection between an electrical plug and an electrical socket formed by a hollow elastically expandable and rolled tube which is rubber-like and has a longitudinal axis extending to opposed ends with an elastically rolled ring at each end for securing the tube to the plug and socket.

10 Claims, 5 Drawing Sheets

SECURITY COUPLING

BACKGROUND OF THE INVENTION

This invention relates to the secure coupling of devices, and more particularly, to the secure coupling of electrical plugs to mating sockets.

The coupling of an electrical plug of one electrical line to a mating socket of another electrical line ordinarily is accomplished by inserting conductors of one line,that extend from the plug, into socket recesses containing internal conductors of the other line, so that the conductors of the plug are mated to those of the socket. Unfortunately, since the plug conductors are easily inserted into socket recesses, they are easily detached, for example by someone who accidentally comes into contact with coupled lines or trips on them.

In addition, it is important to avoid having the coupling come into contact with contaminants, such as moisture, which can interfere with the coupling, or in the case of an electrical coupling, cause a short-circuit.

One form of "Protective Enclosure for Electrical Plug Connection" is the flexible sheath disclosed by L. W. Nelson in U.S. Pat. No. 4,869,683, which issued Sep. 26, 1989. The sheath in Nelson has two separated longitudinal edges. These edges are interengageable by a zipper to form a tubular sheath with limiting straps at the tubular extremities of the sheath. The limiting straps apply compressive force to underlying sealing bands which grip electrical cords beyond the position of plug connection.

The Nelson device has the evident disadvantage of requiring a zipper to form the protective sheath. To overcome this disadvantage, M. J. Shotey in U.S. Pat. No. 5,147,216 issued Sep. 15, 1992, discloses a "Shroud for In-line Electrical Plug". Shotey's shroud or sheath encircles an in-line electrical connector and has opposed ends that are closed about the lines that extend from the connector. Prior to the connection, the shroud or sheath is positioned on one of the lines. After the connection, the shroud is moved over the mid-point and the ends of the shroud are bunched or crimped over the lines. Straps are then wrapped about the ends. Unfortunately if the straps become accidentally disengaged, either by inadvertent contact or as a result of strap wear, the shroud no longer affords any protection to the line connection. In particular the presence and requirement of straps for completing the closure increases the chances of accidental disengagement. In addition when the closure straps become frayed, they can be pulled away, leaving the sheath without a facility for closure.

Accordingly, it is an object of the invention to enhance the security that can be afforded to the coupling of two devices, such as an electrical plug and mating socket. A related object is to eliminate the need for the straps that are required in both the Nelson and Shotey protectors of the prior art.

Another object of the invention is to enhance the protection that can be afforded against contaminants, such as moisture and dust, as well as inadvertent contact with conductors.

Still another object is to enhance the range of plug and receptacle sizes that can be accommodated by a coupling protector.

A further object of the invention is to simplify the structure of protective devices for couplings, thus reducing their cost and simplifying their manufacturing procedure.

SUMMARY OF THE INVENTION

In accomplishing the foregoing and related objects, the invention provides for the secure intercoupling of devices by elastically expandible means having opposed ends; and engagement means at one of the ends for securing the apparatus to one of the devices.

In accordance with one aspect of the invention the elastically expandible means is a tube with a longitudinal axis and an interior with ribs to strengthen the elastically expandible means. The ribs can take a variety or forms, which can be plain of uniform material or a non-overlapping spiral. The ribs can be exteriorly or interiorly positioned, and the tube can have a thickness dimension with reinforcing threads inlaid therein.

The elastically expandible means can be an elastomer, including rubber, and the engaging means can comprise a ring that is rollable over one of the devices.

The devices can be electrical connectors, comprising a plug and a socket, and the engaging means can be a starter lip for facilitating the positioning of the tube over one of the devices.

In a method of the invention for the secure intercoupling of devices, the steps include (a) positioning an elastic member or tube on one of the devices; and engaging one of the devices at one of its ends. The elastic tube has a longitudinal axis and can have ribs that are positioned interiorly or exteriorly to strengthen the tube. The tube further can be reinforced by inlaid threads.

The elastic tube can be formed of rubber with engaging means formed by a ring that is rollable over one of the devices.

BRIEF DESCRIPTION OF THE DRAWINGS

Other aspects of the invention will become apparent after considering several illustrative embodiments taken in conjunction with the drawings, in which.

DETAILED DESCRIPTION

Figure 1:
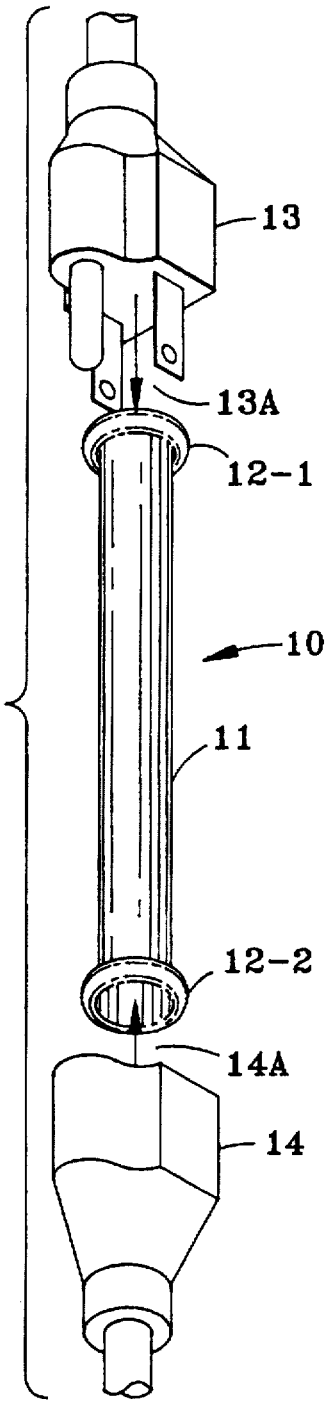
FIG. 1 is a perspective view of a security coupling device in accordance with the invention shown with a plug and socket that are to be coupled.

With reference to FIG. 1, the security coupling device 10 of the invention is an elastic tube 11 with rollable ends 12-1 and 12-2. While the tube 11 has a circular cross-section, it will be appreciated that other forms of closed cross-section may be used as well, for example elliptical and polygonal. In addition the tube is desirably of elastomeric material which allows the tube 11 to accommodate various protuberances on the devices being interconnected. As indicated in FIG. 1 the coupling device 11 is intended for the secure fastening of a plug 13 to a socket 14 by moving the plug 13 in the direction indicated by the arrow 13A into the coupling device 11, and by moving the socket 14 in the direction indicated by the arrow 14A into the coupling device 11. To accomplish this movement the coupling device 11 is expanded over the plug 13 and the socket 14 and the plug is inserted into the socket in conventional fashion to produce the end result indicated in FIG. 2, which is a perspective view of the security coupling device 11 of FIG. 1 after the plug and socket have been coupled.

In another method of coupling, the security coupling device of the invention can have a tapered body and be positioned over a dummy plug or socket to its outer edge. Then a socket or plug to be coupled is inserted into the dummy plug or socket and coupling device rolled over the inserted socket or plug and beyond the dummy plug or socket.

Alternatively, the taper of the dummy plug or socket can be used to expand the coupling device appropriately. The coupling device is positioned below the taper on the dummy plug or socket, and is unrolled and rolled up over the taper to the outer end of the dummy plug or socket, so that when the real socket or plug is temporarily connected to the dummy plug or socket, coupling device can be positioned on the real socket or plug. Thereafter the dummy plug or socket is disconnected and the plug or socket that is to be coupled to the previously inserted socket or plug is joined to the plug or socket being coupled. The protective coupling is completed by partial rolling back over the new plug or socket.

The use of a dummy plug or socket provides a convenient way of storing the security coupling device of the invention until it is ready for use. When the body of the coupling device is tapered, it can be either unidirectionally tapered or bidirectionally tapered, with the taper increasing from the ends of the device towards its center.

Figure 3:
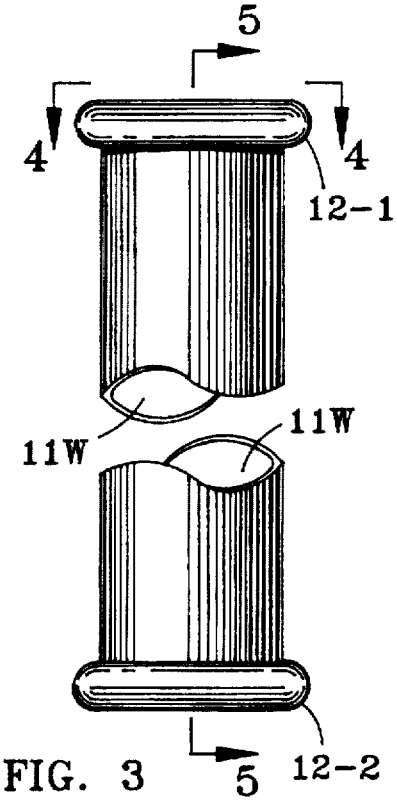
FIG. 3 is an elevation view of the security coupling device of FIG. 1.
Figure 4:
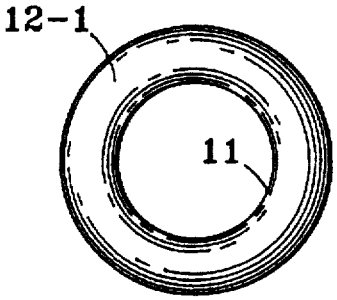
FIG. 4 is an end view of the security coupling device of FIG. 3.

An enlarged elevation view of the security coupling device 11 of FIG. 1 is shown in FIG. 3 with a comparatively thin wall 11*w* to facilitate radial or lateral expansion of the coupling device 11 over objects to be coupled. In addition the thin wall 11*w* provides rolled ends 12-1 and 12-2 which can facilitate the secure coupling procedure. An end view of the rolled end 12-1 for the security coupling device 11 is shown in FIG. 4.

Figure 5A:
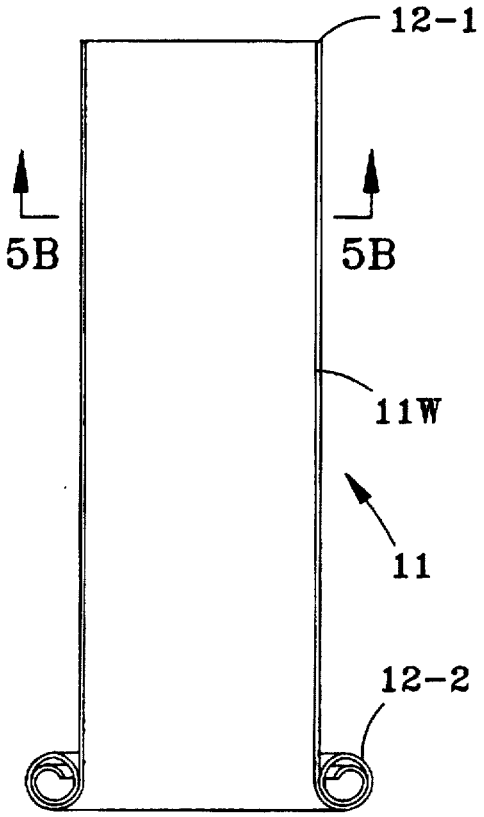
FIG. 5A is a sectional view of the security coupling device of FIG. 3 taken along the lines 5—5.
Figure 5B:
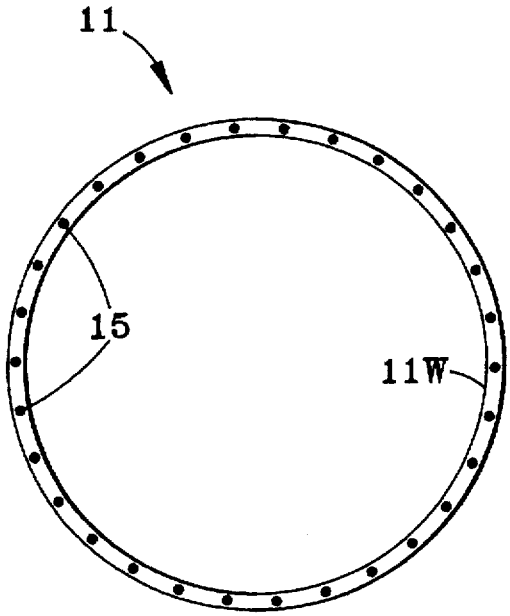
FIG. 5B is a sectional view of the security coupling device of FIG. 5A taken along the lines 5B—5B.

In section the security coupling device 11 of FIG. 3 is as shown in FIG. 5A, with the end 12-1 fully unrolled, and the end 12-2 partially rolled. In the sectional view of FIG. 5B the security coupling device 11 of FIG. 5A is seen to have reinforcing filaments 15 which extend longitudinally and thus do not inhibit lateral expansion of the kind illustrated in FIG. 2. The reinforcing filaments may be of any suitable metallic or polymeric material.

Figure 2:
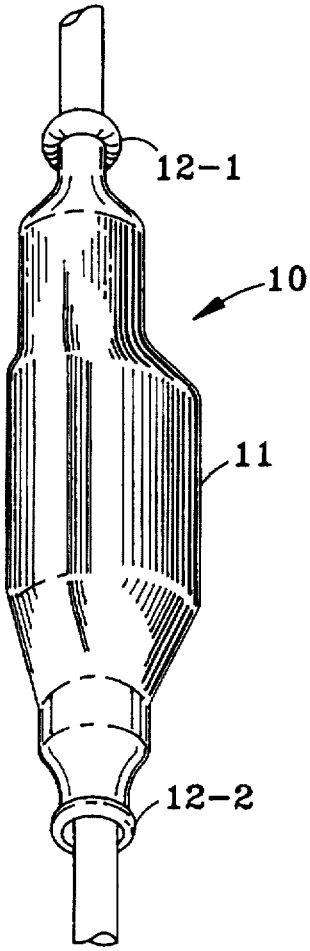
FIG. 2 is a perspective view of the security coupling device of FIG. 1 after the plug and socket have been coupled and the device deployed.
Figure 5C:
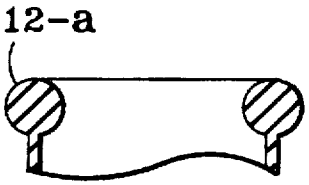
FIGS. 5C through 5E are partial sectional views showing alternative ends for the security coupling device of FIG. 3.
Figure 5D:
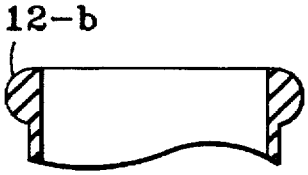
Figure 5E:
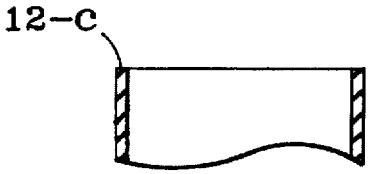

In FIGS. 5C through 5E partial sectional views for the coupling device 11 have various alternative ends **12-*a* through 12-*c* for providing suitable engagement members on at least one of the ends 12-1 or 12-2 for securing the coupling device 11 to a device. In FIG. 5C the end 12-*a*** is fully rounded, while in FIG. 5-*b* the end **12-*b* is partially rounded. In FIG. 5E the end 12-*c* is rectangular and coincident with the wall 11***w*. In all cases the ends **12-*a* through 12-*b* are rollable as indicated in FIGS. 1 through 3. It will be appreciated that other suitable ends may be provided for the coupling device 11**.

Figure 6A:
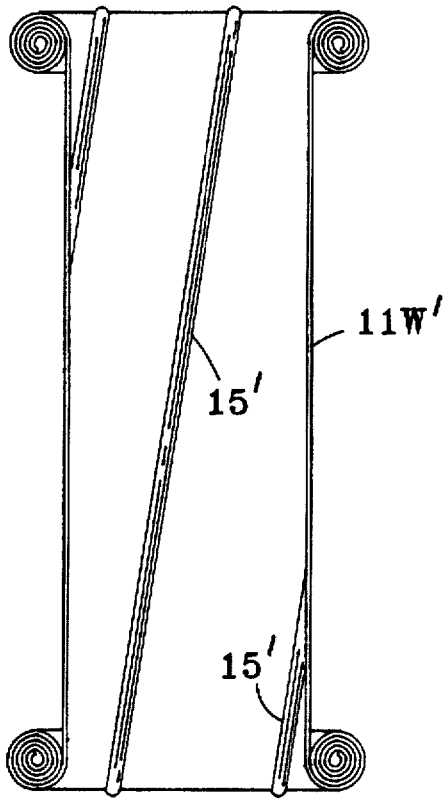
FIG. 6A is a sectional view of an alternative security coupling device of the invention.
Figure 6B:
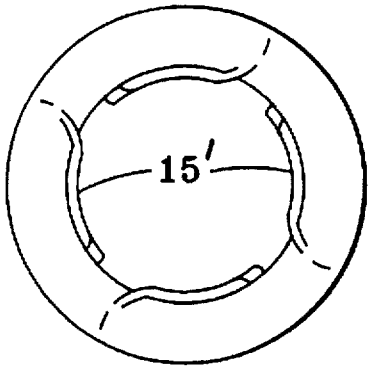
FIG. 6B is an end view of the security coupling device of FIG. 6A, before sectioning.

In the alternative security coupling device 11', shown in longitudinal section in FIG. 6A, the wall 11*w'* is provided with reinforcement ribs 15' that are non-overlapping when end rolling takes place and are further illustrated in the end view of FIG. 6B, before sectioning.

Figure 7A:
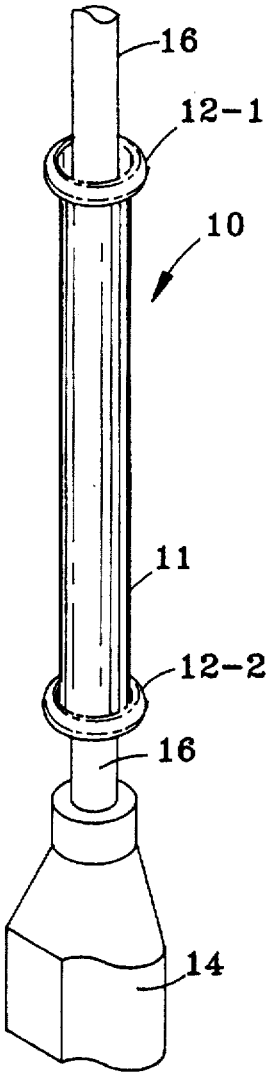
FIG. 7A shows the possible positioning of the coupling device of the invention on the cord of a socket preparatory to coupling to a plug.
Figure 7B:
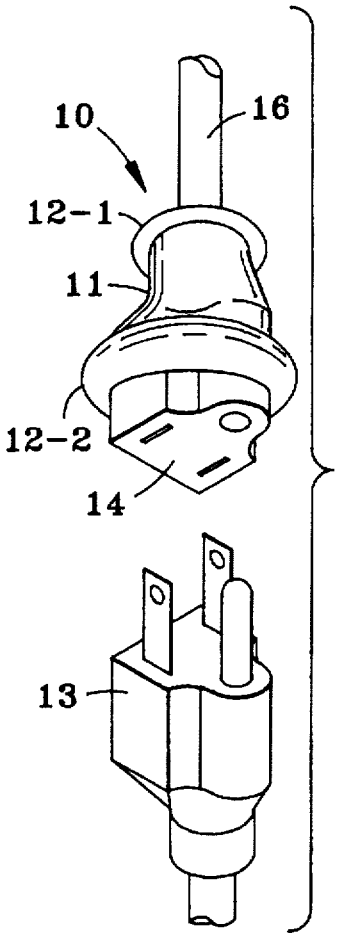
FIG. 7B shows the coupling device of the invention positioned rolled up on the socket of FIG. 7A preparatory to coupling to a plug.

FIG. 7A shows the coupling device 11 of the invention positioned on a cord 16 attached to the socket 14 preparatory to coupling to a plug. This positioning of the coupling device 11 provides convenient storage when the coupling device 11 is not being used. As shown in FIG. 7B, when the coupling device 11 is to be used, it is pushed forwardly and rolled over the socket 14. The plug 13 is pushed into the socket 14 and the end 12-2 of coupling device 11 is rolled forwardly over the plug 13 to achieve the configuration shown in FIG. 7C.

Figure 7C:
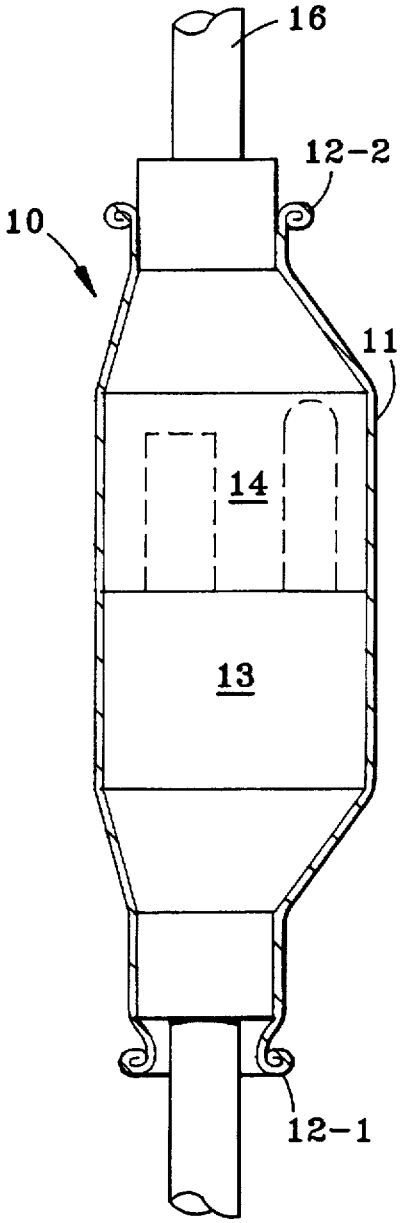
FIG. 7C shows a sectional view of the coupling device of the invention positioned over the socket of FIGS. 7A and 7B, and over the plug of FIG. 7B.
Figure 7D:
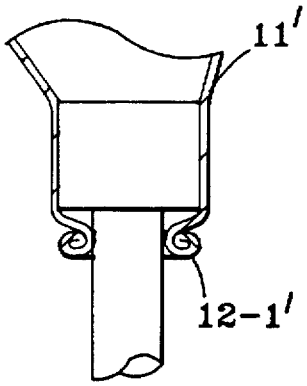
FIG. 7D shows an alternative security position for the coupling device of the invention on the plug of FIG. 7C.

An alternative security position for the coupling device 11 of the invention on the plug of FIG. 7C is shown in FIG. 7D where the end 12-1' is proportioned to snugly surround the cord 16, as opposed to having a gap between the the end 12-1 and the cord 16 as shown in FIG. 7C.

Figure 8A:
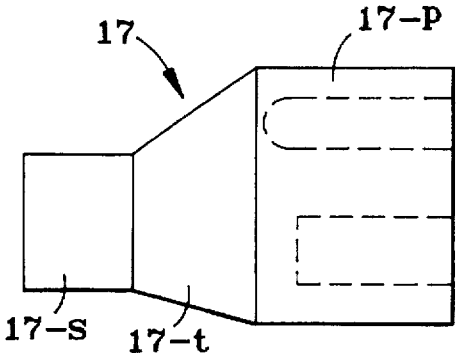
FIGS. 8A through 8D show a preferred technique for the intercoupling of a plug and a socket making use of a dummy plug.
Figure 8B:
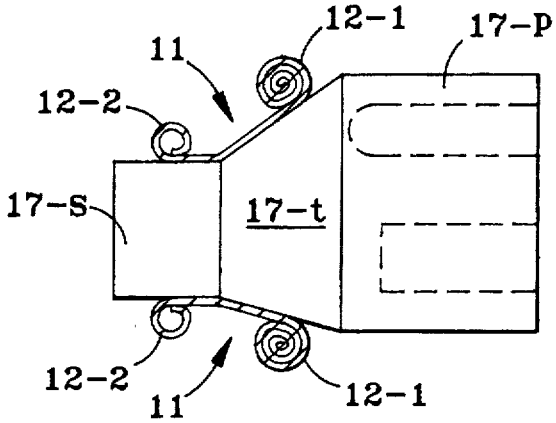
Figure 8C:
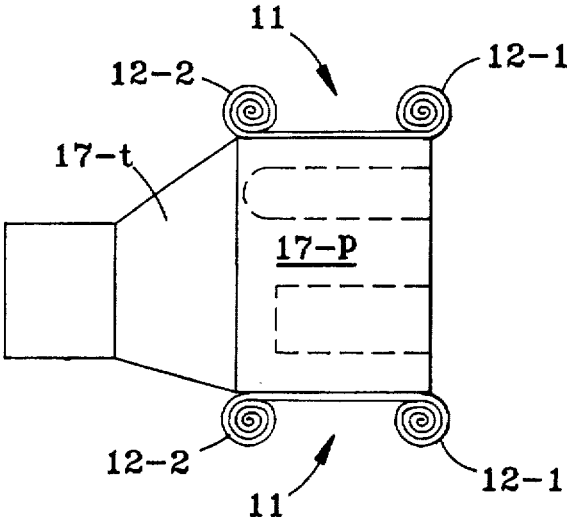
Figure 8D:
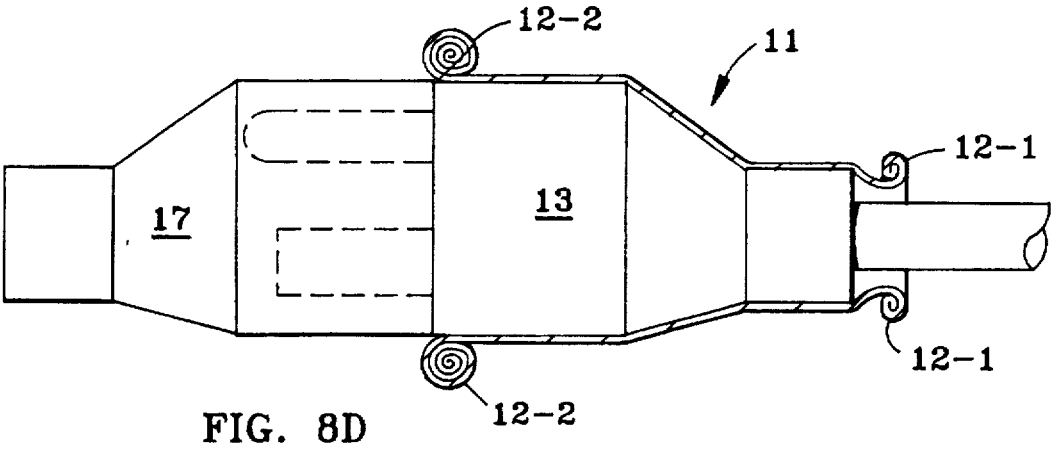

With reference to FIGS. 8A through 8D, a preferred technique is illustrated for the intercoupling of the plug 13 and the socket 14 making use of a dummy socket (or plug) 17. The dummy socket 17 is shown in FIG. 8A with a taper **17-*t* extending from a shank 17-*s*. A coupling device 11 of the invention is initially positioned on the shank 17-*s* and taper 17-*t* as shown in FIG. 8B. Thereafter the coupling device 11 is expanded over the taper 17-*t* of the dummy socket 17 to the outer portion 17-*p* as shown in FIG. 8C. Then, as indicated in FIG. 8D, the coupling device 11 is transferred from the dummy socket 17 to the plug 13. In the final step the dummy socket is removed and replaced by an actual socket 14, and the coupling device 11** positioned as shown in FIG. 7C.

It will be appreciated that the foregoing detailed description is illustrative only and that modifications and alterations, including equivalents, may be made without departing from the spirit and scope of the invention as defined in the appended claims.

What is claimed:

1. An electrical apparatus for securing a connection between an electrical plug and an electrical socket comprising:

an elastically expandable, hollow and rolled tube having opposed ends; and an elastically rolled ring at each of said ends for securing said tube to said plug and socket;

wherein said tube is rubber-like and has a longitudinal axis.

2. An electrical apparatus as defined in claim 1 wherein said tube has non-overlapping ribs along said axis;

thereby to strengthen said elastically expandable tube longitudinally.

3. An electrical apparatus as defined in claim 1 wherein said elastically expandable tube has a thickness dimension with reinforcing threads inlaid within said thickness dimension.

4. An electrical apparatus as defined in claim 1 wherein said rolled ring is bi-directionally rollable over one of said plug and socket.

5. An electrical apparatus as defined in claim 1 wherein said elastically rolled ring comprises a starter lip for facilitating the position of said tube over one of said plug and socket.

6. An electrical apparatus as defined in claim 1 wherein said elastically rolled ring means at one of said ends for securing said apparatus to one of said plug and socket comprises a squared end.

7. The method of securing a connection between a plug and socket comprising the steps of:

(a) positioning a rolled elastic tube member on one of said plug and socket; and (b) unrolling said member for engaging another one of said plug and socket;

wherein said elastic member is positionable over a plug or socket to its outer edge; and said elastic member is rolled over from said plug or socket.

8. The method as defined in claim 7 wherein said elastic member has a longitudinal axis and non-overlapping spiral ribs are positioned therealong to strengthen said member.

9. The method as defined in claim 7 wherein said elastic member has a thickness dimension and reinforcing threads are inlaid therein.

10. The method as defined in claim 7 wherein said elastic member is formed of rubber.

* * * * *